US011278072B2

(12) United States Patent
Anceresi et al.

(10) Patent No.: US 11,278,072 B2
(45) **Date of Patent: *Mar. 22, 2022**

(54) MAGNETIC FASTENER FOR AN ARTICLE OF FOOTWEAR

(71) Applicant: NIKE, Inc., Beaverton, OR (US)

(72) Inventors: Giorgio Anceresi, Portland, OR (US); Eric Y. Lee, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 56 days.

This patent is subject to a terminal disclaimer.

(21) Appl. No.: 16/889,948

(22) Filed: Jun. 2, 2020

(65) Prior Publication Data

US 2020/0288800 A1 Sep. 17, 2020

Related U.S. Application Data

(63) Continuation of application No. 16/111,902, filed on Aug. 24, 2018, now Pat. No. 10,674,779.

(60) Provisional application No. 62/552,115, filed on Aug. 30, 2017.

(51) Int. Cl.

| | |
|---|---|
| ***A41F 1/00*** | (2006.01) |
| ***A43B 1/00*** | (2006.01) |
| ***A43B 3/00*** | (2022.01) |
| ***A43B 23/24*** | (2006.01) |
| ***A43C 11/24*** | (2006.01) |
| ***A43C 11/00*** | (2006.01) |
| *A43C 11/12* | (2006.01) |

(52) U.S. Cl.

CPC ..... *A41F 1/002* (2013.01); *A43B 1/0054* (2013.01); *A43B 3/0078* (2013.01); *A43B 23/24* (2013.01); *A43C 11/00* (2013.01); *A43C 11/24* (2013.01); *A43C 11/12* (2013.01)

(58) Field of Classification Search

CPC ..... A43C 11/00; A43C 11/06; A43C 11/24; A43B 1/0054; A41F 1/002

USPC ..... 36/50.1

See application file for complete search history.

(56) References Cited

U.S. PATENT DOCUMENTS

| | | | | |
|---|---|---|---|---|
| 2,637,887 A * | 5/1953 | Goodman | ..... | A44C 5/2071 24/303 |
| D456,130 S * | 4/2002 | Towns | ..... | A43B 1/0054 D2/978 |
| 6,880,270 B2 * | 4/2005 | Prather | ..... | A41F 1/002 24/303 |

(Continued)

FOREIGN PATENT DOCUMENTS

| | | |
|---|---|---|
| CA | 2717279 A1 | 4/2011 |
| CN | 201905326 U | 7/2011 |
| CN | 105919226 A | 9/2016 |

*Primary Examiner* — Marie D Bays

(74) *Attorney, Agent, or Firm* — Quinn IP Law

(57) ABSTRACT

A magnetic fastener such as for an article of footwear comprises a male fastener portion and a female fastener portion. The male fastener portion is configured to magnetically fasten to the female fastener portion. The female fastener portion defines a recess with an outer periphery that is asymmetric about a center axis of the recess. The male fastener portion fits into the recess when the male fastener portion is in a first orientation relative to the female fastener portion, and interferes with the female fastener portion when the male fastener portion is urged to rotate about the center axis of the recess away from the first orientation.

20 Claims, 4 Drawing Sheets

(56) References Cited

U.S. PATENT DOCUMENTS

| | | | | |
|---|---|---|---|---|
| 8,794,682 | B2 * | 8/2014 | Fiedler | E05B 15/04 292/251.5 |
| 10,674,779 | B2 * | 6/2020 | Anceresi | A43B 3/0078 |
| 2002/0078596 | A1 * | 6/2002 | Towns | A43C 11/14 36/50.1 |
| 2002/0095751 | A1 * | 7/2002 | Reiter | H01F 7/0263 24/303 |
| 2005/0102802 | A1 * | 5/2005 | Sitbon | A44C 5/2071 24/303 |
| 2005/0126041 | A1 * | 6/2005 | Gonzalez Palacio | A43B 23/24 36/50.1 |
| 2007/0028429 | A1 * | 2/2007 | Ishida | A45C 13/1069 24/303 |
| 2011/0265289 | A1 * | 11/2011 | Wu | H01F 7/0263 24/303 |
| 2013/0276205 | A1 * | 10/2013 | Madore | A44B 99/00 2/160 |
| 2015/0089839 | A1 | 4/2015 | James et al. | |
| 2016/0331084 | A1 * | 11/2016 | Xanthos | A43C 5/00 |

* cited by examiner

MAGNETIC FASTENER FOR AN ARTICLE OF FOOTWEAR

CROSS-REFERENCE TO RELATED APPLICATIONS

This application is a continuation of U.S. application Ser. No. 16/111,902, filed on Aug. 24, 2018, which claims the benefit of priority to U.S. Provisional Application No. 62/552,115, filed Aug. 30, 2017, both of which are hereby incorporated by reference in their entirety.

TECHNICAL FIELD

The present teachings generally include a magnetic fastener and an article of footwear with a magnetic fastener.

BACKGROUND

An upper of an article of footwear is generally secured around a foot using laces, straps, or other fastening mechanisms. The construction of the upper, the complexity of the fastening mechanism, and the level of tightness may be dependent upon the activity to be undertaken.

BRIEF DESCRIPTION OF THE DRAWINGS

The drawings described herein are for illustrative purposes only, are schematic in nature, and are intended to be exemplary rather than to limit the scope of the disclosure.

DESCRIPTION

Figure 1:
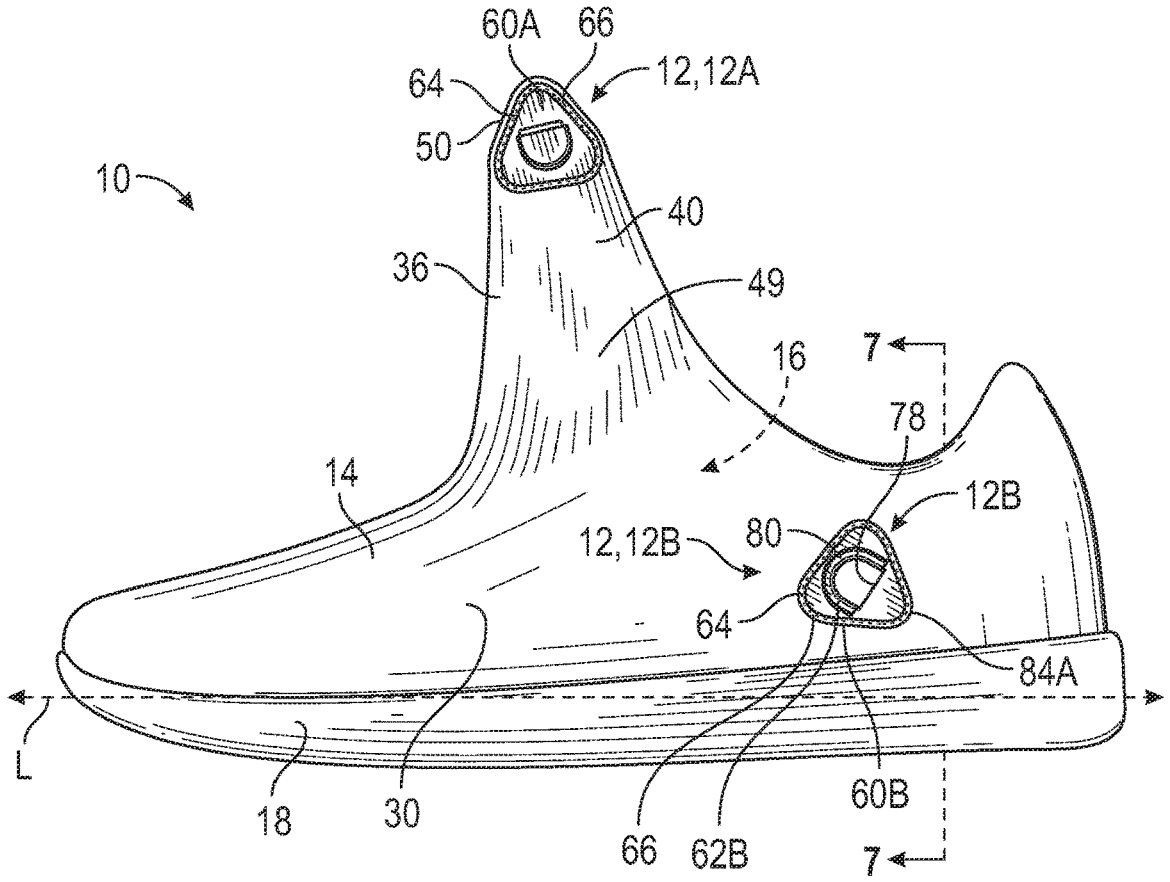
FIG. 1 is a schematic illustration in lateral side view of an article of footwear with a magnetic fastener unfastened.

In accordance with the present disclosure, a magnetic fastener is configured with interfitting male and female fastener portions that enable quick, one-handed fastening and unfastening. The male fastener portion is configured to fit in an asymmetric recess of the female fastener portion which largely confines the male fastener portion to a first orientation, preventing it from twisting relative to the female fastener portion. Strategically positioned walls of the female fastener provide a physical barrier that supplements the magnetic force in maintaining the secured position of the fastener. When used to secure an upper of an article of footwear around a foot, the upper may include a strap contiguous with the sides of the upper, and the fastener may secure a distal end of the strap to one of the sides to tighten the upper around the foot, with one-handed securement and release.

More specifically, an article of footwear comprises an upper defining a foot-receiving cavity, and a magnetic fastener including a male fastener portion fixed to a first portion of the upper and a female fastener portion fixed to a second portion of the upper. The male fastener portion is configured to magnetically fasten to the female fastener portion to tighten the upper around the foot-receiving cavity. The female fastener portion defines a recess with an outer periphery that is asymmetric about a center axis of the recess. The male fastener portion fits into the recess when the male fastener portion is in a first orientation relative to the female fastener portion, and interferes with the female fastener portion when the male fastener portion is urged to rotate about the center axis of the recess away from the first orientation. The female fastener portion thereby limits twisting of the male fastener portion within the recess.

In one or more embodiments, the male fastener portion includes a straight side, a curved side, and a corner at which the straight side and the curved side meet. The female fastener portion includes a straight wall and a curved wall. The male fastener portion fits into the recess in the first orientation with the curved side adjacent to the curved wall, and the straight side adjacent to the straight wall. The corner interferes with the straight wall when the male fastener portion is urged to rotate about the center axis of the recess.

In one or more embodiments of the article of footwear, the curved side of the male fastener is U-shaped, and the curved wall of the female fastener is U-shaped. In these or other embodiments, the curved wall has a first height, and the straight wall has a second height less than the first height.

In one or more embodiments of the article of footwear, the female fastener portion is disposed on the lateral side of the upper with the curved wall generally above the straight wall. This enables the curved wall to act as a barrier against movement of the male fastener portion, such as when forces on the magnetic fastener push the male fastener portion against the curved wall.

In one or more embodiments of the article of footwear, the male fastener portion is stepped at the straight side such that the male fastener portion overlays the female fastener portion outward of the recess at the straight wall of the female fastener portion.

In one or more embodiments of the article of footwear, the curved wall is sloped outward such that the recess is wider at a distal portion of the curved wall than at a proximal portion of the curved wall. The curved side of the male fastener portion is also sloped such that the curved side is flush with the curved wall when the male fastener portion is in the recess. The sloped configuration of the curved wall and the curved side help to center the male portion within the recess of the female portion.

In one or more embodiments of the article of footwear, the male fastener portion includes a first base and a male connector portion that protrudes from the base, the male connector portion having the straight side, the curved side, and the corner. The female fastener portion includes a second base and a female connector portion surrounded by the second base, the female connector portion having the curved wall and the recess, and the second base defining the straight wall. An outer periphery of the first base and an outer periphery of the second base are of a substantially identical shape. For example, each may be triangular with rounded corners. In such embodiments, the male connector portion is aligned with the recess when the outer periphery of the first base of the male fastener portion is aligned with the outer periphery of the second base of the female fastener portion.

In one or more embodiments of the article of footwear, the substantially identical shape of the male fastener portion and the female fastener portion is generally triangular, with a peak of the second base of the female fastener portion disposed downward and rearward on the lateral side of the upper. Aligning the male fastener portion with the female fastener portion may be simplified in such an embodiment, as a corresponding peak of the first base of the male fastener portion generally points in the direction that the portion of the upper on which the male fastener portion is disposed is pulled during fastening.

In one or more embodiments of the article of footwear, the first portion of the upper includes a strap, and the second portion of the upper defines a lateral side of the upper. An inner side of the strap is contiguous with the lateral side of the upper in a unitary construction. The male fastener portion is secured to the inner side of the strap. The upper includes a medial side, and an outer side of the strap is contiguous with the medial side of the upper in a unitary construction. The inner side of the strap confronts an exterior surface of the lateral side of the upper when the male fastener portion is magnetically fastened to the female fastener portion.

In one or more embodiments of the article of footwear, the strap tapers in width from a proximate portion of the strap to a distal portion of the strap.

Within the scope of the present disclosure, a magnetic fastener comprises a male fastener portion and a female fastener portion. The male fastener portion is configured to magnetically fasten to the female fastener portion. The female fastener portion defines a recess with an outer periphery that is asymmetric about a center axis of the recess. The male fastener portion fits into the recess when the male fastener portion is in a first orientation relative to the female fastener portion, and interferes with the female fastener portion when the male fastener portion is urged to rotate about the center axis of the recess away from the first orientation, the female fastener portion thereby preventing twisting of the male fastener portion within the recess.

In one or more embodiments of the fastener, the male fastener portion includes a straight side, a curved side, and a corner at which the straight side and the curved side meet. The female fastener portion includes a straight wall and a curved wall. The male fastener portion fits into the recess with the curved side adjacent to the curved wall, and the straight side adjacent to the straight wall. The corner interferes with the straight wall when the male fastener portion is urged to rotate about the center axis of the recess.

In one or more embodiments of the fastener, the curved side of the male fastener is U-shaped, and the curved wall of the female fastener is U-shaped. In these or other embodiments, the curved wall has a first height, and the straight wall has a second height less than the first height.

In one or more embodiments of the fastener, the straight side of the male fastener portion is stepped such that the male fastener portion overlays the female fastener portion outward of the recess at the straight wall of the female fastener portion.

In one or more embodiments of the fastener, the male fastener portion includes a first base and a male connector portion that protrudes from the base, the male connector portion having the straight side, the curved side, and the corner. The female fastener portion includes a second base and a female connector portion surrounded by the second base, the female connector portion having the curved wall and the recess, and the second base defining the straight wall. An outer periphery of the first base and an outer periphery of the second base are of a substantially identical shape. In such embodiments, the male connector portion is aligned with the recess when the outer periphery of the first base of the male fastener portion is aligned with the outer periphery of the second base of the female fastener portion.

The above features and advantages and other features and advantages of the present teachings are readily apparent from the following detailed description of the modes for carrying out the present teachings when taken in connection with the accompanying drawings.

Figure 2:
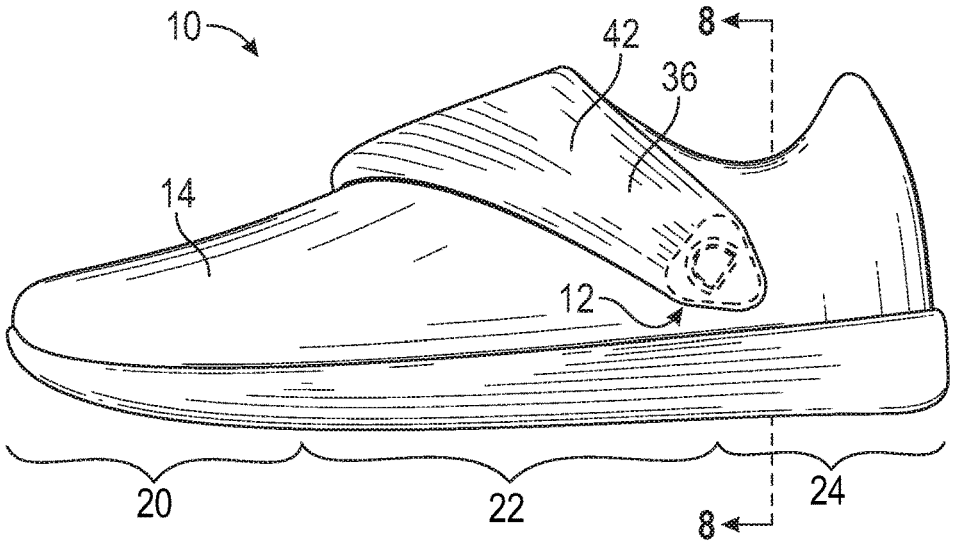
FIG. 2 is a schematic illustration in lateral side view of the article of footwear of FIG. 1 with the magnetic fastener fastened.
Figure 7:
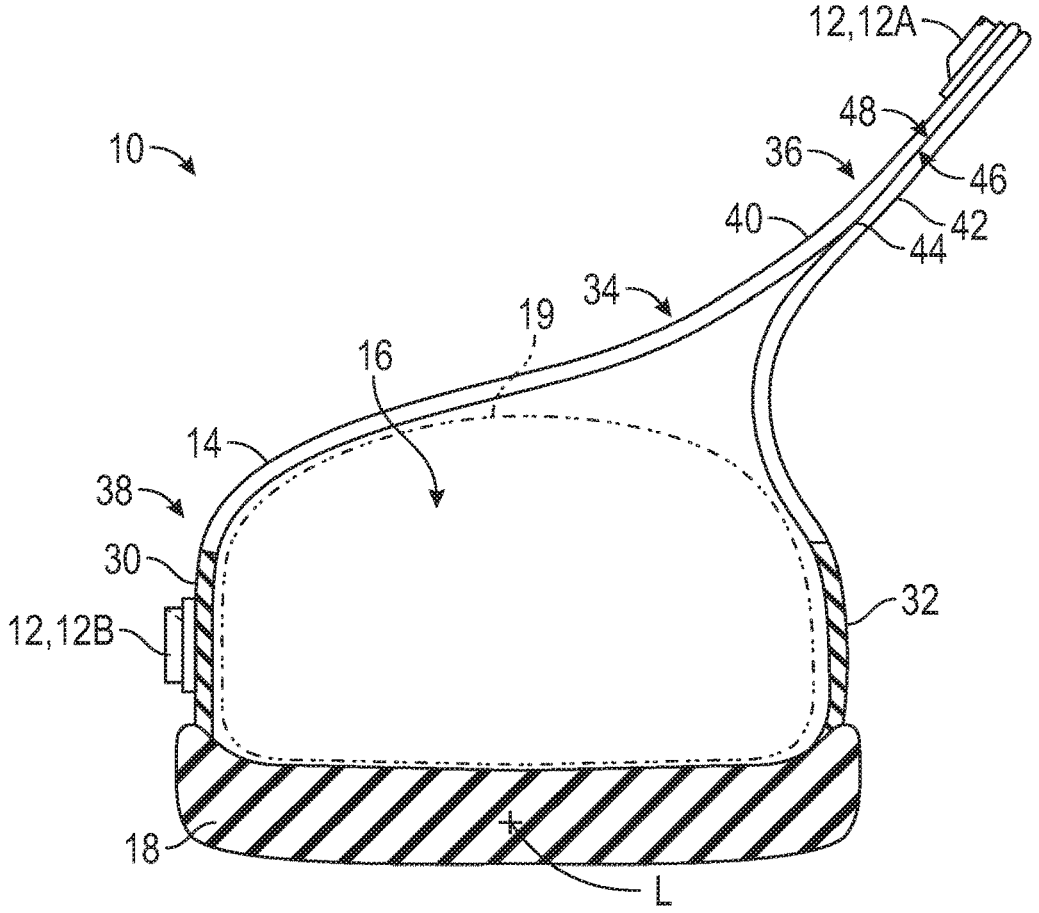
FIG. 7 is a schematic illustration in partial cross-sectional view of the article of footwear of FIG. 1 taken at lines 7-7 in FIG. 1.
Figure 8:
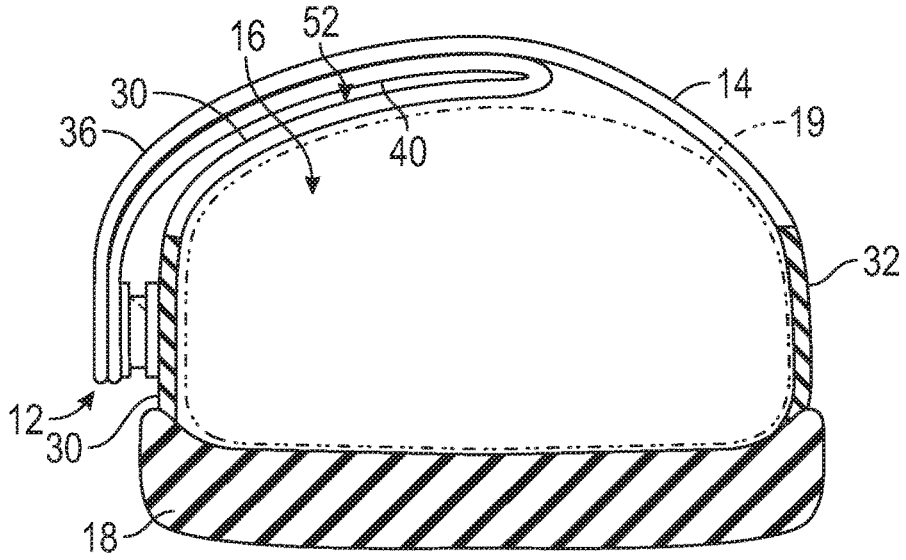
FIG. 8 is a schematic illustration in partial cross-sectional view of the article of footwear of FIG. 2 taken at lines 8-8 in FIG. 2.

Referring to the drawings, wherein like reference numbers refer to like components throughout the views, FIG. 1 shows a lateral side view of an article of footwear 10. As further described herein, the article of footwear 10 includes a magnetic fastener 12 that is shown unfastened in FIG. 1 and fastened in FIG. 2. More specifically, the magnetic fastener 12 includes a male fastener portion 12A and a female fastener portion 12B each of which are secured to different portions of an upper 14 of the article of footwear. As shown in FIGS. 7 and 8, the magnetic fastener 12 is configured for easy and quick magnetic fastening and unfastening of the male fastener portion 12A to the female fastener portion 12B to respectively tighten and loosen the upper 14 around a foot 19 disposed in a foot-receiving cavity 16 (foot 19 shown in phantom in FIGS. 7 and 8).

Referring to FIG. 1, the article of footwear 10 includes a sole structure 18 that underlies the upper 14. The sole structure 18 is shown as a single, one-piece, unitary midsole and outsole, but the sole structure 18 of the article of footwear 10 may have any configuration within the scope of the present teachings. For example, the sole structure 18 may include one or more sole components that may be separate sole layers, such as an outsole and one or more midsole layers. In further configurations, the sole structure 18 may incorporate fluid-filled chambers, plates, moderators, or other elements that further attenuate forces, enhance stability, or influence the motions of the foot. In one non-limiting example, the sole structure 18 as shown as a unitary midsole and outsole may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. Discrete outsole elements such as of a wear-resistant rubber material that may be textured to impart traction, and/or traction elements such as tread elements or cleats may be secured to a bottom surface of the sole structure 18.

The upper 14 is secured to the sole structure 18. For example, a lower extremity of the upper 14 may be bonded or otherwise secured to the sole structure 18 as shown in FIGS. 7 and 8. In other embodiments, a strobel (not shown) may be secured to the lower extremity of the upper 14 and to the sole structure 18, or the upper 14 may continue under the foot 19 in a sock configuration. An insole (not shown) may overlie the sole structure 18 within the foot-receiving cavity 16. The upper 14 is configured to receive and retain the foot 19 in the foot-receiving cavity 16 so that the foot 19 is supported on the sole structure 18 with the sole structure 18 positioned below the foot 19, and between the foot 19 and the ground.

The article of footwear 10 has a forefoot portion 20, a midfoot portion 22 and a heel portion 24. Both the upper 14 and the sole structure 18 extend in and partially define the forefoot portion 20, the midfoot portion 22 and the heel portion 24 indicated in FIG. 2. The article of footwear 10 has a lateral side 30 (FIG. 1) and a medial side 32 (shown in FIGS. 7 and 8) opposite from the lateral side 30. The lateral side 30 and the medial side 32 extend through each of forefoot region 20, the midfoot region 22, and the heel region 24 and correspond with opposite sides of the article of footwear 10. The forefoot region 20, the midfoot region 22, the heel region 24, the lateral side 30 and the medial side 32 are not intended to demarcate precise areas of footwear 10, but are instead intended to represent general areas of the article footwear 10 to aid in the discussion. The article of footwear 10 shown in configured for a left foot. An article of footwear for a right foot has a mirror image of that shown, and is within the scope of the present teachings.

The upper 14 may be a variety of materials, such as leather, textiles, polymers, cotton, foam, composites, etc. In non-limiting examples, the upper 14 may be a polymeric material capable of providing elasticity to the upper 14 and may be of braided construction, a knitted (e.g., warp-knitted) construction or a woven construction. As shown, the upper 14 is a soft, flexible material and may include multiple layers.

Referring to FIG. 7, a first portion 34 of the upper 14 includes a strap 36. A second portion 38 of the upper 14 includes the lateral side 30 of the upper. The female fastener portion 12B is secured to the lateral side 30 of the upper 14 as shown in FIG. 1. An inner side 40 of the strap 36 is contiguous with the lateral side 30 of the upper in a unitary construction. Stated differently, the material of the upper 14 that forms the lateral side 30 also forms the inner side of the strap 36, and extends without interruption from the lateral side 30 to the strap 36. The male fastener portion 12A is disposed on and secured to the inner side 40 of the strap 36.

Similarly, an outer side 42 of the strap 36 is contiguous with the medial side 32 of the upper 14 in a unitary construction in that the material of the upper 14 that forms the medial side 32 also forms the outer side 42 of the strap 36, and extends without interruption from the medial side 32 to the strap 36. The inner side 40 of the strap 36 may be sewn or otherwise secured to the outer side 42 of the strap 36 at a seam 44 where the sides 40, 42 meet, as shown in FIG. 7, so that an inner surface 46 of the inner side 40 of the strap 36 confronts an inner surface 48 of the outer side 42 of the strap 36. Alternatively, the entire upper 14 including the lateral and medial sides 30, 32 and the strap 36 can be an integral one-piece unit, such as by knitting or otherwise.

As best shown in FIG. 1, the strap 36 tapers in width (i.e., the width of the strap 36 is in a fore-aft direction of the article of footwear 10) from a proximal portion 49 of the strap 36 proximate the foot-receiving cavity 16 a distal portion 50 of the strap 36. The fore-aft direction of the article of footwear 10 is the longitudinal direction that extends from the heel portion 24 toward the forefoot portion 20 along a longitudinal midline L (shown in FIG. 1 and FIG. 7) of the article of footwear 10. The male fastener portion 12A is secured adjacent to the distal portion 50.

In FIGS. 1 and 7, the strap 36 is shown in a lifted position such as by a user's hand (not shown) midway through moving the strap 36 to fasten the male fastener portion 12A to the female fastener portion 12B. The strap 36 is of a sufficient length that it can be pulled over the instep of the foot 19 downward and rearward from its position in FIG. 1 to the secured position in FIG. 2 in which the male fastener portion 12A is magnetically fastened to the female fastener portion 12B. The inner side 40 of the strap 36 confronts an exterior surface 52 of the lateral side 30 of the upper 14 when the male fastener portion 12A is magnetically fastened to the female fastener portion 12B, as best shown in FIG. 8.

Figure 3:
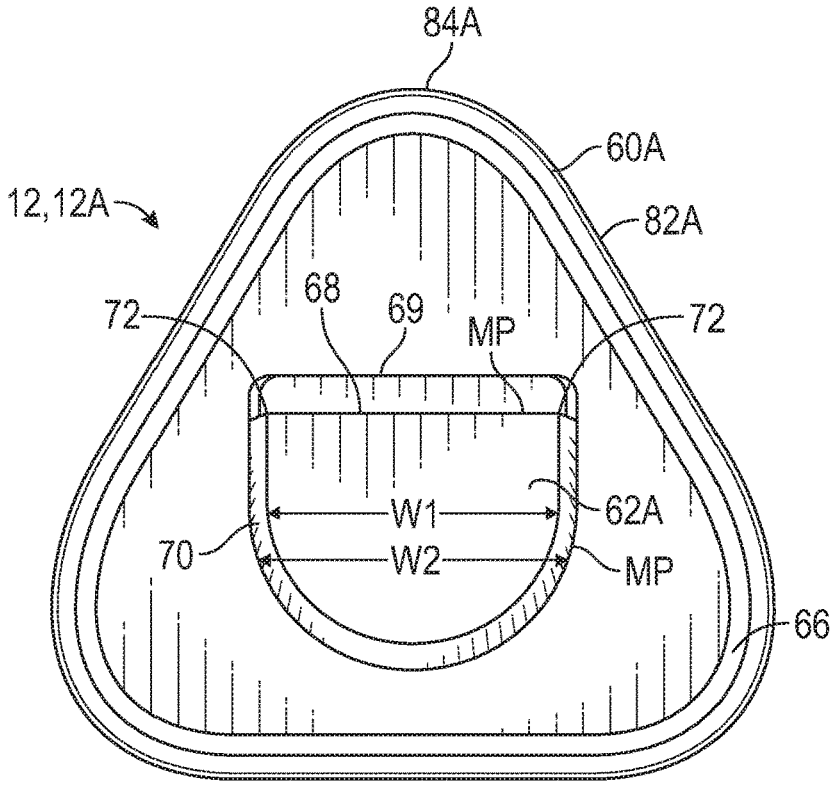
FIG. 3 is a schematic illustration in plan view of a male fastener portion of the magnetic fastener of FIGS. 1 and 2.

Referring to FIGS. 3-6, features of the fastener 12 are shown in further detail. FIG. 3 shows the male fastener portion 12A, including a first base 60A and a male connector portion 62A that protrudes from the first base 60A. The female fastener portion 12B also has a second base 60B and a female connector portion 62B that at least partially protrudes from and is surrounded laterally and from below by the second base 60B. At least one of the connector portions 62A or 62B is magnetic. If either is not magnetic, it is a material that is attracted to a magnet, such as iron or steel, so that in all embodiments the connector portions 62A, 62B are attracted to one another and the fastener portions 12A, 12B fasten to one another via a magnetic force. The bases 60A, 60B may be a flexible rubber or other polymeric material that can be stitched, adhered, or otherwise secured to the upper 14.

Figure 5:
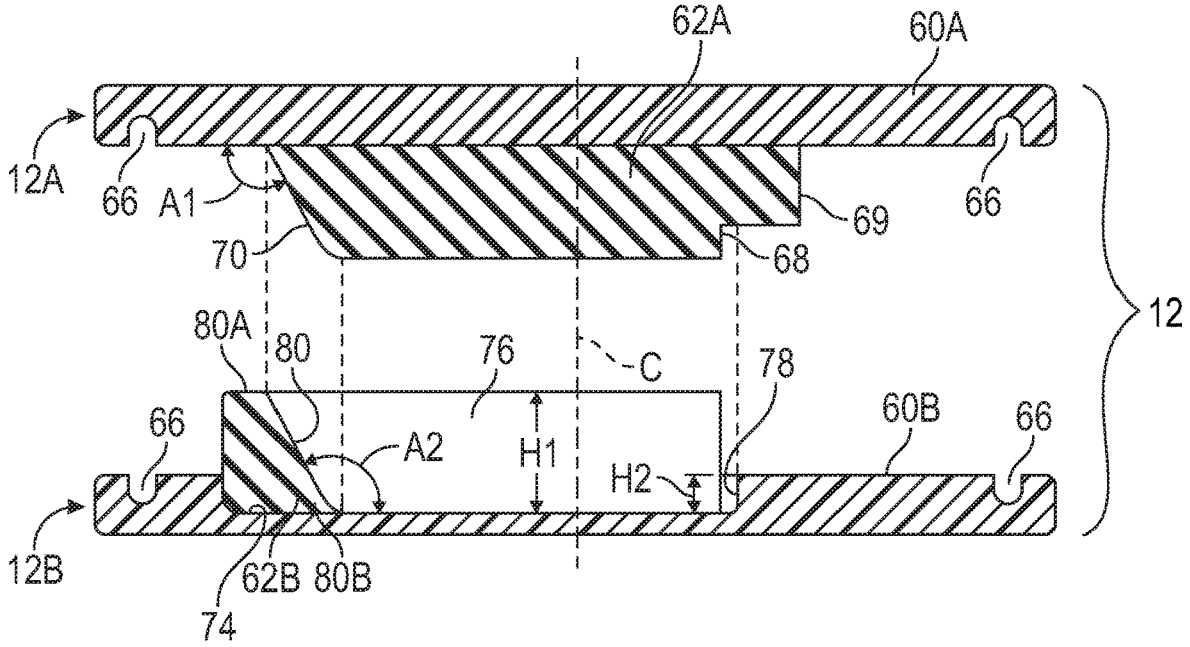
FIG. 5 is a schematic illustration in exploded cross-sectional view of the magnetic fastener of FIGS. 1-2 taken at lines 5-5 in FIG. 6.

As shown in FIG. 1, the first base 60A is stitched to the upper 14 with stitching 64 through a thinned groove 66 of the first base 60. In FIG. 5, the groove 66 is shown in cross-sectional view. The groove 66 surrounds the male connector portion 62A and generally corresponds to the shape of an outer periphery of the first base 60A. The second base 60B also has a thinned groove 66 that surrounds the female connector portion 62B and generally corresponds to the shape of an outer periphery of the second base 60B. The second base 60B is stitched to the lateral side 30 of the upper 14 with stitching 64 through the thinned groove 66.

The connector portion 62A of the male fastener portion 12A includes a straight side 68, a curved side 70, and corners 72 at which the straight side and the curved side meet. The straight side 68, the curved side 70, and one or more corners 72 at least partially define an outer periphery MP of the male connector portion 62A. The curved side 70 of the male connector portion 62A is U-shaped in plan view of FIG. 3, and is also sloped. Stated differently, and as best shown in FIG. 5, the curved side 70 of the male connector portion 62A extends at an obtuse angle A1 from the first base 60A such that the male connector portion 62A tapers in width in a direction away from the first base 60A at the curved side 70. For example, as shown in FIG. 3, a distal portion of the connector portion 62A (i.e., the portion furthest from the first base 60A) has a first width W1, while a proximal portion of the connector portion 62A (i.e., the portion closest to the first base 60A) has a second width W2 greater than the first width W1).

Figure 4:
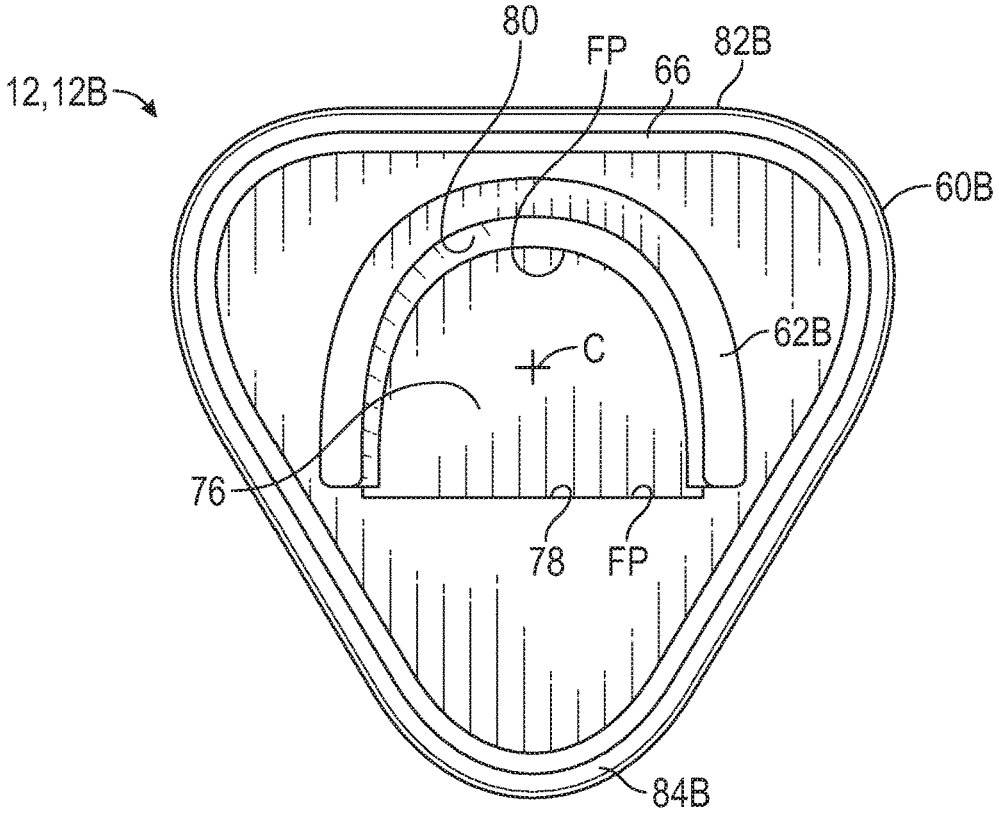
FIG. 4 is a schematic illustration in plan view of a female fastener portion of the magnetic fastener of FIGS. 1 and 2.

With reference to FIG. 5, the second base 60B of the female fastener portion 12B has a slight recess 74 in which the female connector portion 62B is secured such as with adhesive. Alternatively or additionally, the female connector portion 62B may have a flange that fits within a slot of the second base 60B at a perimeter of the recess 74. The female connector portion 62B of the female fastener portion 12B also defines a recess 76 which is a sub-portion of the recess 74. As best shown in FIG. 4, the outer periphery FP of the recess 76 is asymmetric about a center axis C of the recess 76. The center axis C extends in the direction of the depth of the recess 76, i.e., perpendicular to the second base 60B. The second base 60B defines a straight wall 78 bounding the recess 74 and also bounds the recess 76. The female connector portion 62B includes a curved wall 80 that bounds the recess 76. The curved wall 80 is U-shaped. The curved wall 80 and the straight wall 78 thus substantially define the outer perimeter FP of the recess 76 and cause the recess 76 to be asymmetrical about the center axis C.

As best shown in FIG. 5, the curved wall 80 has a first height H1, and the straight wall 78 has a second height H2 that is less than the first height. The lower height H2 may ease entry of the male connector portion 62A into the recess 76 if the strap 36 is pulled sufficiently far so that the curved side 70 is to the right of the position shown in FIG. 5, and then is moved to approach the curved wall 80 in a downward and leftward direction in the view of FIG. 5. In other words, entry of the male connector portion 62A into the recess 76 can occur from slightly above the straight wall 78 and downward back toward the curved wall 80 instead of straight downward along the center axis C as would be required if the straight wall 78 was of the same height as the curved wall 80.

As shown in FIG. 1, the female fastener portion 12B is disposed on and secured to the lateral side 30 of the upper 14 with the curved wall 80 generally above the straight wall 78. This enables the curved wall 80 to act as a barrier against movement of the male fastener portion 12A, such as when forces on the strap 36 pull the male fastener portion 12A against the curved wall 80. For example, if the strap 36 is under tension in the secured position of FIG. 2 in which the fastener 12 is fastened, in addition to the magnetic force holding the fastener 12 fastened, the curved wall 80 helps retain the fastener 12 in the fastened position.

The curved wall 80 is sloped outward such that it extends at an obtuse angle A2 relative to the second base 60B, causing the recess 76 to be wider at a distal portion 80A of the curved wall 80 than at a proximal portion 80B of the curved wall 80. Additionally, the angle A1 of the curved side 70 matches the angle A2 of the curved wall 80 such that the curved side 70 is flush with the curved wall 80 when the male connector portion 62A is in the recess 76. The sloped configuration of the curved wall 80 and the curved side 70 help to center the male connector portion 62A within the recess 76 of the female fastener portion 12B. The male connector portion 62A is stepped at the straight side 68 the such that the male connector portion 62A overlays the base 60B of the female fastener portion 12B with a terminal wall 69 outward of the recess 76 at the straight wall 78.

The male connector portion 62A fits into the recess 76 when the male fastener portion 12A is in a first orientation relative to the female fastener portion 12B. Namely, in the first orientation, the straight side 68 is parallel with the straight wall 78 and the curved side 70 is flush with the curved wall 80. Due to the asymmetric recess 76, the male connector portion 62A is generally confined to this first orientation when in the recess 76. For example, when the male fastener portion 12A is urged to rotate about the center axis C of the recess 76 away from the first orientation, one of the corners 72 will interfere with the female fastener portion 12B at the straight wall 78. For example, in FIG. 6, if the male fastener portion 12A is urged to twist slightly clockwise about the center axis C such as by tensile or other forces on the strap 36, the straight side 68 is no longer parallel to the straight wall 78, and the right corner 72 interferes with the straight wall 78 as represented in phantom by the straight side in position 68A. The female fastener portion 12B thereby limits twisting of the male connector portion 62A within the recess 76. The tapered shape of the strap 36 is beneficial as it flares wider proximate the foot-receiving cavity 16 so that it provides tension and support over a wide swatch of the instep. However, the wider proximal portion 49 causes forces to be applied over a wider range of directions on the male fastener portion 12A when in the fastened position, which could urge the male connector portion 62A to twist about the center axis C. Accordingly, the configuration of the asymmetrical recess 76 and the interfering straight wall 78 is particularly useful in combination with an upper 14 having a strap that is tapered such as tapered strap 36.

In an embodiment, the curved wall 80 may have a slot along its lower inner periphery adjacent the recess 76, at the proximal portion 80B. The distal portion of the curved side 70 of the male connector portion 62A may have a flange around its perimeter. The flange may be sized to slide into the slot when the male connector portion 62A is fit into the recess 76. The slot may have a height taller than the height H1 of the straight wall 78 and the ends of the slot may be open near the straight wall 78, so that the flange can be slid into the slot if the male connector portion 62A enters the recess 76 from just above the straight wall 78 and in a direction that is downward and toward the curved wall 70.

Figure 6:
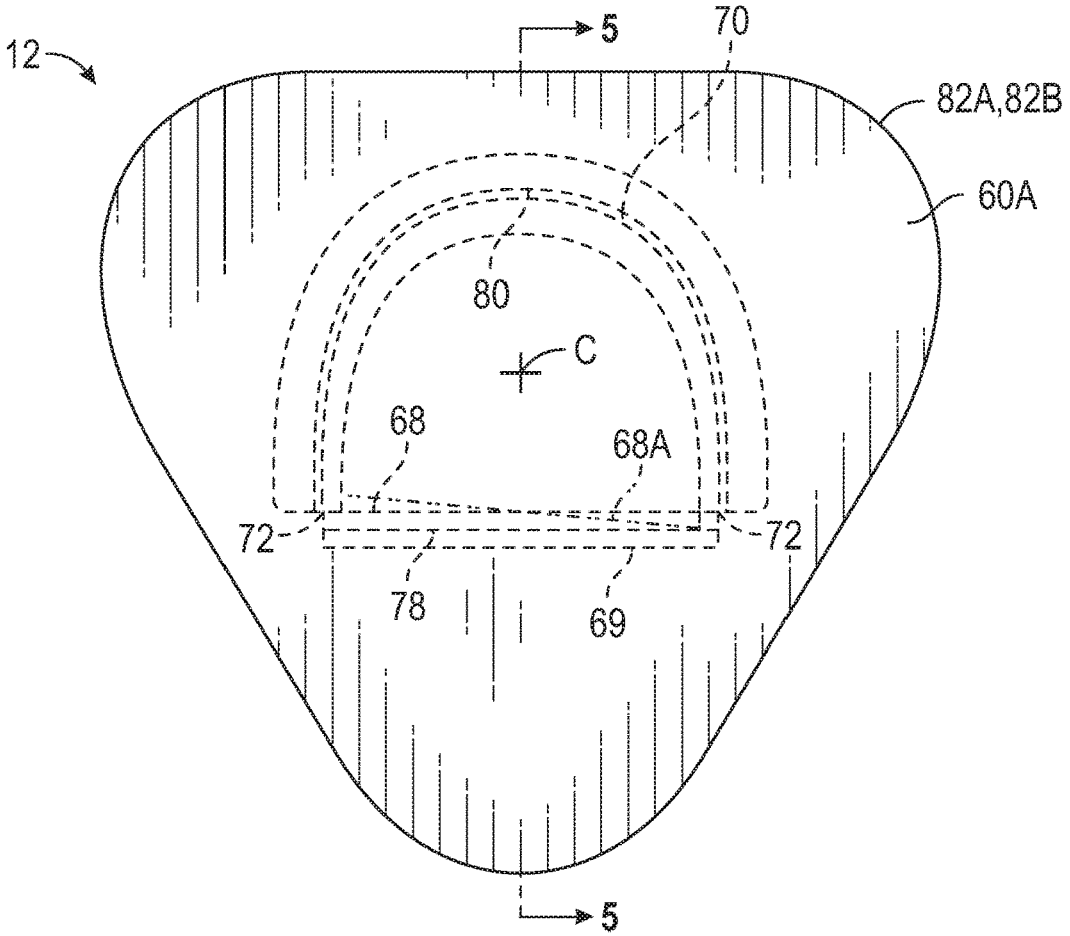
FIG. 6 is a schematic illustration in plan view of the magnetic fastener of FIGS. 1-2 with the male fastener portion shown in hidden lines in a first orientation fit in a recess of the female fastener portion, and showing a second orientation of the male fastener portion in phantom.

As is evident in FIGS. 3-4 and 6, the outer periphery 82A of the base 60A of the male fastener portion 12A and an outer periphery 82B of the base 60B of the female fastener portion 12B are of a substantially identical shape. For example, each may be triangular with rounded corners as shown. However, other substantially identical shapes may be used within the scope of the present disclosure.

Additionally, the connector portions 62A, 62B are disposed on their respective bases 60A, 60B so that the male connector portion 62A is aligned with the recess 76 when the outer periphery 82A of the first base 60A of the male fastener portion 12A is aligned with the outer periphery 82B of the second base 60B of the female fastener portion 12B. For example, when peak 84A of the first base 60A is aligned with peak 84B of the second base 60B (with the male fastener portion 12A inverted from the position of FIG. 3), the connector portion 62A is aligned with the recess 76.

As shown in FIG. 1, the female fastener portion 12B is secured to the upper 14 so that the peak 84A of the second base 60B of the female fastener portion 12B is disposed downward and rearward on the lateral side 30 of the upper 14. Aligning the male fastener portion 12A with the female fastener portion 12B to quickly secure the fastener 12 may be simplified in such an embodiment, as the corresponding peak 84A of the first base 60A of the male fastener portion 12A generally points in the direction that the strap 36 is pulled during fastening. In other words, during the pulling motion used to tighten the strap 36, the peaks 84A, 84B can be aligned and the male fastener portion 12A will be aligned with the female fastener portion 12B with little or no adjustments in the direction of pull. Simply pulling the strap 36 rearward and downward will position the male fastener portion 12A above the female fastener portion 12B. Once in the vicinity of the female portion 12B, the magnetic force of the magnetic material of one or both connector portions 62A, 62B will tend to pull the male connector portion 62A into the recess 76 in the first orientation.

The following Clauses provide example configurations of an article of footwear disclosed herein.

Clause 1: An article of footwear comprising: an upper defining a foot-receiving cavity; a magnetic fastener including a male fastener portion fixed to a first portion of the upper and a female fastener portion fixed to a second portion of the upper, wherein the male fastener portion is configured to magnetically fasten to the female fastener portion to tighten the upper around the foot-receiving cavity; wherein the female fastener portion defines a recess with an outer periphery that is asymmetric about a center axis of the recess; and wherein the male fastener portion fits into the recess when the male fastener portion is in a first orientation relative to the female fastener portion, and interferes with the female fastener portion when the male fastener portion is urged to rotate about the center axis of the recess away from the first orientation.

Clause 2: The article of footwear of Clause 1, wherein: the male fastener portion includes a straight side, a curved side, and a corner at which the straight side and the curved side meet; the female fastener portion includes a straight wall and a curved wall; the male fastener portion fits into the recess in the first orientation with the curved side adjacent to the curved wall, and the straight side adjacent to the straight wall; and wherein the corner interferes with the straight wall when the male fastener portion is urged to rotate about the center axis of the recess.

Clause 3: The article of footwear of Clause 2, wherein the curved side is U-shaped, and the curved wall is U-shaped.

Clause 4: The article of footwear of any of Clauses 2-3, wherein the curved wall has a first height, and the straight wall has a second height less than the first height.

Clause 5: The article of footwear of Clause 4, wherein the female fastener portion is disposed on the lateral side of the upper with the curved wall generally above the straight wall.

Clause 6: The article of footwear of any of Clauses 4-5, wherein the male fastener portion is stepped at the straight side such that the male fastener portion overlays the female fastener portion outward of the recess at the straight wall of the female fastener portion.

Clause 7: The article of footwear of any of Clauses 2-6, wherein the curved wall is sloped such that the recess is wider at a distal portion of the curved wall than at a proximal portion of the curved wall; and wherein the curved side of the male fastener portion is sloped such that the curved side is flush with the curved wall when the male fastener portion is in the recess.

Clause 8: The article of footwear of any of Clauses 2-7, wherein: the male fastener portion includes a first base and a male connector portion that protrudes from the base, the male connector portion having the straight side, the curved side, and the corner; the female fastener portion includes a second base and a female connector portion surrounded by the second base, the female connector portion having the curved wall and the recess, and the second base defining the straight wall; and an outer periphery of the first base and an outer periphery of the second base are of a substantially identical shape.

Clause 9: The article of footwear of Clause 8, wherein the male connector portion is aligned with the recess when the outer periphery of the first base of the male fastener portion is aligned with the outer periphery of the second base of the female fastener portion.

Clause 10: The article of footwear of any of Clauses 8-9, wherein the substantially identical shape is generally triangular, with a peak of the second base of the female fastener portion disposed downward and rearward on the lateral side of the upper.

Clause 11: The article of footwear of any of Clauses 1-10, wherein: the first portion of the upper includes a strap, and the second portion of the upper defines a lateral side of the upper; an inner side of the strap is contiguous with the lateral side of the upper in a unitary construction; the male fastener portion is secured to the inner side of the strap; the upper includes a medial side; and an outer side of the strap is contiguous with the medial side of the upper in a unitary construction.

Clause 12: The article of footwear of Clause 11, wherein the inner side of the strap confronts an exterior surface of the lateral side of the upper when the male fastener portion is magnetically fastened to the female fastener portion.

Clause 13: The article of footwear of any of Clauses 11-12, wherein the strap tapers in width from a proximate portion of the strap to a distal portion of the strap.

Clause 14: A magnetic fastener comprising: a male fastener portion and a female fastener portion, wherein the male fastener portion is configured to magnetically fasten to the female fastener portion; wherein the female fastener portion defines a recess with an outer periphery that is asymmetric about a center axis of the recess; and wherein the male fastener portion fits into the recess in the first orientation when the male fastener portion is in a first orientation relative to the female fastener portion, and interferes with the female fastener portion when the male fastener portion is urged to rotate about the center axis of the recess away from the first orientation, the female fastener portion thereby preventing twisting of the male fastener portion within the recess.

Clause 15: The magnetic fastener of Clause 14, wherein: the male fastener portion includes a straight side, a curved side, and a corner at which the straight side and the curved side meet; the female fastener portion includes a straight wall and a curved wall; the male fastener portion fits into the recess with the curved side adjacent to the curved wall, and the straight side adjacent to the straight wall; and wherein the corner interferes with the straight wall when the male fastener portion is urged to rotate about the center axis of the recess.

Clause 16: The magnetic fastener of Clause 15, wherein the curved side is U-shaped, and the curved wall is U-shaped.

Clause 17: The magnetic fastener of any of Clauses 15-16, wherein the curved wall has a first height, and the straight wall has a second height less than the first height.

Clause 18: The magnetic fastener of any of Clauses 15-17, wherein the straight side is stepped such that the male fastener portion overlays the female fastener portion outward of the recess at the straight wall.

Clause 19: The magnetic fastener of any of Clauses 15-18, wherein: the male fastener portion includes a first base and a male connector portion that protrudes from the base, the male connector portion having the straight side, the curved side, and the corner; the female fastener portion includes a second base and a female connector portion surrounded by the second base, the female connector portion having the curved wall and the recess, and the second base defining the straight wall; and an outer periphery of the first base and an outer periphery of the second base are of a substantially identical shape.

Clause 20: The magnetic fastener of Clause 19, wherein the connector portion is aligned with the recess when the outer periphery of the first base of the male fastener portion is aligned with the outer periphery of the second base of the female fastener portion.

To assist and clarify the subsequent description of various embodiments, various terms are defined herein. Unless otherwise indicated, the following definitions apply throughout this specification (including the claims).

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range. All references referred to are incorporated herein in their entirety.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives are employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal", as used throughout this detailed description and in the claims, refers to a direction extending a length of a component. For example, a longitudinal direction of a shoe extends between a forefoot region and a heel region of the shoe. The term "forward" is used to refer to the general direction from a heel region toward a forefoot region, and the term "rearward" is used to refer to the opposite direction, i.e., the direction from the forefoot region toward the heel region. In some cases, a component may be identified with a longitudinal axis as well as a forward and rearward longitudinal direction along that axis.

The term "vertical", as used throughout this detailed description and in the claims, refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, and may generally point towards the sole, or towards the outermost components of the sole.

The term "proximal" refers to a direction that is nearer a center of a footwear component, or is closer toward a foot when the foot is inserted in the article as it is worn by a user. Likewise, the term "distal" refers to a relative position that is further away from a center of the footwear component or is further from a foot when the foot is inserted in the article as it is worn by a user. Thus, the terms proximal and distal may be understood to provide generally opposing terms to describe the relative spatial position of a footwear component.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. A magnetic fastener comprising:

a male fastener portion and a female fastener portion, wherein the male fastener portion is configured to magnetically fasten to the female fastener portion;

wherein the female fastener portion has walls that define a recess with an asymmetric outer periphery, the walls including a relatively high wall and a relatively low wall adjacent to the relatively high wall; and wherein the male fastener portion fits into the recess against the walls of the female fastener portion and extending over the relatively low wall.

2. The magnetic fastener of claim 1, wherein:

the asymmetric outer periphery of the recess is asymmetric about a center axis of the recess; and the male fastener portion fits into the recess when the male fastener portion is in a first orientation relative to the female fastener portion, and interferes with the female fastener portion when the male fastener portion is urged to rotate about the center axis of the recess away from the first orientation.

3. The magnetic fastener of claim 2, wherein:

the male fastener portion includes a straight side, a curved side, and a corner at which the straight side and the curved side meet;

the relatively high wall of the female fastener portion is a curved wall and the relatively low wall of the female fastener portion is a straight wall;

the male fastener portion fits into the recess in the first orientation with the curved side adjacent to the curved wall, and the straight side adjacent to the straight wall; and the corner interferes with the straight wall when the male fastener portion is urged to rotate about the center axis of the recess.

4. The magnetic fastener of claim 3, wherein the curved side is U-shaped, and the curved wall is U-shaped.

5. The magnetic fastener of claim 3, wherein the male fastener portion is stepped at the straight side such that the male fastener portion overlays the female fastener portion outward of the recess at the straight wall of the female fastener portion.

6. The magnetic fastener of claim 3, wherein:

the curved wall is sloped such that the recess is wider at a distal portion of the curved wall than at a proximal portion of the curved wall; and the curved side of the male fastener portion is sloped such that the curved side is flush with the curved wall when the male fastener portion is in the recess.

7. The magnetic fastener of claim 3, wherein:

the male fastener portion includes a first base and a male connector portion that protrudes from the first base, the male connector portion having the straight side, the curved side, and the corner; and the female fastener portion includes a second base and a female connector portion surrounded by the second base, the female connector portion having the curved wall and the recess, and the second base defining the straight wall.

8. The magnetic fastener of claim 7, wherein the male connector portion is aligned with the recess when an outer periphery of the first base of the male fastener portion is aligned with an outer periphery of the second base of the female fastener portion.

9. An article comprising:

a flexible material;

a strap extending from the flexible material; and a magnetic fastener including a male fastener portion and a female fastener portion, one of the male fastener portion and the female fastener portion fixed to the flexible material and the other of the male fastener portion and the female fastener portion fixed to the strap, wherein the male fastener portion is configured to magnetically fasten to the female fastener portion to tighten the strap around the flexible material;

wherein the female fastener portion has walls that define a recess with an asymmetric outer periphery, the walls including a relatively high wall and a relatively low wall adjacent to the relatively high wall; and wherein the male fastener portion fits into the recess against the walls of the female fastener portion and extending over the relatively low wall.

10. The article of claim 9, wherein:

the asymmetric outer periphery of the recess is asymmetric about a center axis of the recess; and the male fastener portion fits into the recess when the male fastener portion is in a first orientation relative to the female fastener portion, and interferes with the female fastener portion when the male fastener portion is urged to rotate about the center axis of the recess away from the first orientation.

11. The article of claim 10, wherein:

the male fastener portion includes a straight side, a curved side, and a corner at which the straight side and the curved side meet;

the relatively high wall of the female fastener portion is a curved wall and the relatively low wall of the female fastener portion is a straight wall;

the male fastener portion fits into the recess in the first orientation with the curved side adjacent to the curved wall, and the straight side adjacent to the straight wall; and the corner interferes with the straight wall when the male fastener portion is urged to rotate about the center axis of the recess.

12. The article of claim 11, wherein the curved side is U-shaped, and the curved wall is U-shaped.

13. The article of claim 11, wherein the male fastener portion is stepped at the straight side such that the male fastener portion overlays the female fastener portion outward of the recess at the straight wall of the female fastener portion.

14. The article of claim 11, wherein:

the curved wall is sloped such that the recess is wider at a distal portion of the curved wall than at a proximal portion of the curved wall; and the curved side of the male fastener portion is sloped such that the curved side is flush with the curved wall when the male fastener portion is in the recess.

15. The article of claim 11, wherein:

the male fastener portion includes a first base and a male connector portion that protrudes from the first base, the male connector portion having the straight side, the curved side, and the corner; and the female fastener portion includes a second base and a female connector portion surrounded by the second base, the female connector portion having the curved wall and the recess, and the second base defining the straight wall.

16. The article of claim 15, wherein the male connector portion is aligned with the recess when an outer periphery of the first base of the male fastener portion is aligned with an outer periphery of the second base of the female fastener portion.

17. The article of claim 11, wherein:

the article is an article of footwear; and the flexible material is an upper.

18. The article of claim 17, wherein:

the female fastener portion is disposed on a lateral side of the upper with the curved wall generally above the straight wall;

an inner side of the strap is contiguous with the lateral side of the upper in a unitary construction; the male fastener portion is secured to the inner side of the strap; and an outer side of the strap is contiguous with a medial side of the upper in a unitary construction.

19. The article of claim 18, wherein the inner side of the strap confronts an exterior surface of the lateral side of the upper when the male fastener portion is magnetically fastened to the female fastener portion.

20. The article of claim 9, wherein the strap tapers in width from a proximate portion of the strap to a distal portion of the strap.

* * * * *